US006807881B2

(12) United States Patent
Wu

(10) Patent No.: US 6,807,881 B2
(45) Date of Patent: Oct. 26, 2004

(54) RATCHET WRENCH HAVING SWITCH LOCKING DEVICE

(76) Inventor: Izu Min Wu, P.O. Box 63-99, Taichung (TW), 406

( * ) Notice: Subject to any disclaimer, the term of this patent is extended or adjusted under 35 U.S.C. 154(b) by 61 days.

(21) Appl. No.: 10/402,786

(22) Filed: Mar. 28, 2003

(65) Prior Publication Data

US 2004/0187647 A1 Sep. 30, 2004

(51) Int. Cl.[7] ..... B25B 13/00
(52) U.S. Cl. ..... 81/59.1; 81/60
(58) Field of Search ..... 81/59.1, 60, 58; 192/43, 44, 45

(56) References Cited

U.S. PATENT DOCUMENTS 4,137,801 A * 2/1979 Imperio ..... 81/58.1
4,528,873 A * 7/1985 Lee ..... 81/57.29
4,987,803 A 1/1991 Chern ..... 81/57.39
5,499,559 A 3/1996 Lin ..... 81/59.1
6,311,584 B1 11/2001 Chu ..... 81/57.29

* cited by examiner

*Primary Examiner*—Derris H. Banks
*Assistant Examiner*—J. Williams

(57) ABSTRACT

A ratchet wrench includes a driving head having two actuating surfaces and a corner formed in a chamber, a driven member rotatably received in the driving head, and a rod engaged between the driving head and the driven member and movable across the corner to engage with either of the actuating surfaces of the driving head. A detent device may be selectively engaged with the rod, to prevent the rod from moving across the corner of the driving head, and to retain the rod in engagement with either of the actuating surfaces of the driving head, and to prevent the rod to engage with different actuating surface inadvertently.

7 Claims, 5 Drawing Sheets

RATCHET WRENCH HAVING SWITCH LOCKING DEVICE

BACKGROUND OF THE INVENTION

1. Field of the Invention

The present invention relates to a ratchet wrench, and more particularly to a ratchet wrench having a switch locking device to lock the ratchet wrench, and to prevent the ratchet wrench from being rotated or driven in different directions.

2. Description of the Prior Art

Various kinds of typical ratchet wrenches have been developed for rotating or driving fasteners, sockets, tool extensions, or the like.

For example, U.S. Pat. No. 4,987,803 to Chern, and U.S. Pat. No. 5,499,559 to Lin, and U.S. Pat. No. 6,311,584 to Chu disclose three of the typical ratchet wrenches and comprise a number of rods or rollers disposed in a socket opening of a driving head or handle, and engaged between the driving head and a driving shank.

The typical ratchet wrenches may further comprise a switching or actuating member to engage with the rollers, and to move the rollers relative to the driving head and the driving shank, in order to control the driving directions of the typical ratchet wrenches.

However, the switching or actuating member may not be locked in place, or the rollers may not be locked to the driving head, and may be moved relative to the driving head inadvertently, particularly when the typical ratchet wrenches are rotated or driven quickly by the users, such that the switching or actuating member or the rollers may be moved to different position of the driving head, and the driving direction of the typical ratchet wrenches may be changed inadvertently.

The present invention has arisen to mitigate and/or obviate the afore-described disadvantages of the conventional switching or actuating members for the ratchet wrenches.

SUMMARY OF THE INVENTION

The primary objective of the present invention is to provide a ratchet wrench including a switch locking device to lock the switching or actuating member of the ratchet wrench, and to prevent the ratchet wrench from being switched to different rotating or driving directions.

In accordance with one aspect of the invention, there is provided a ratchet wrench comprising a driving head including a chamber formed therein, and including a first actuating surface and a second actuating surface, and a corner formed between the first and the second actuating surfaces of the driving head, a driven member rotatably received in the chamber of the driving head, a rod received in the chamber of the driving head, and engaged between the driving head and the driven member, and movable across the corner of the driving head, to engage with either the first actuating surface or the second actuating surface of the driving head, and means for preventing the rod from moving across the corner of the driving head, to retain the rod in engagement with either the first actuating surface or the second actuating surface of the driving head.

The preventing means includes a detent slidable into the chamber of the driving head, to engage with the rod, and to retain the rod in engagement with either the first actuating surface or the second actuating surface of the driving head. The driving head includes a groove formed therein and communicating with the chamber thereof to slidably receive the detent therein.

The preventing means further includes an actuating device slidably received in the driving head, to selectively force the detent into the chamber of the driving head and to engage with the rod. The actuating device includes a stem having a seat provided therein, to selectively engage with the detent, and thus to selectively force the detent into the chamber of the driving head and to engage with the rod.

The stem of the actuating device includes a cavity formed therein, to selectively receive the detent, and to allow the detent to be disengaged from the chamber of the driving head and to be disengaged from the rod. A spring biasing device may further be provided for biasing the seat to engage with the detent.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
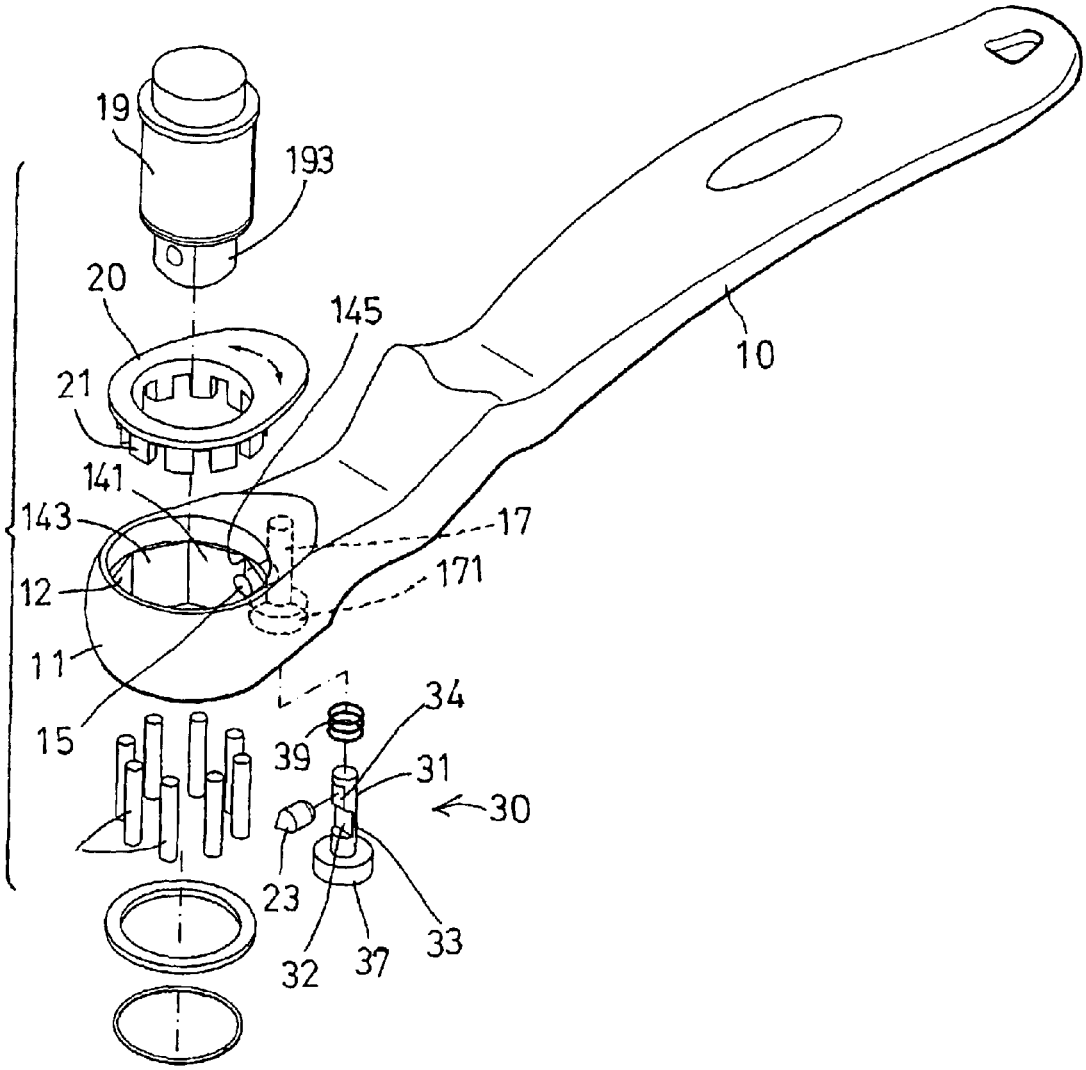
FIG. 1 is an exploded view of a ratchet wrench in accordance with the present invention.
Figure 2:
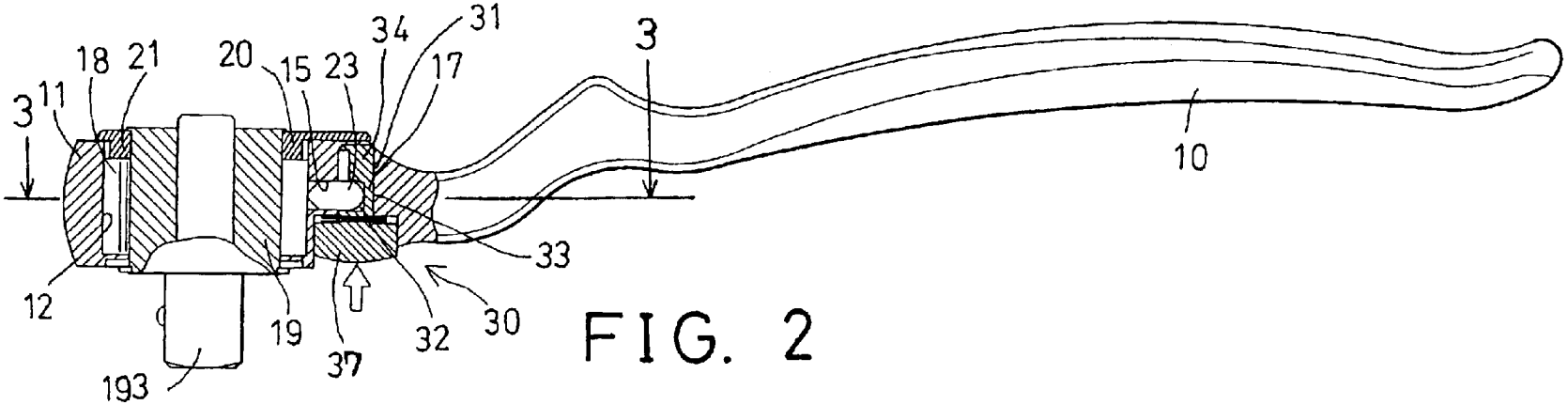
FIG. 2 is a partial cross sectional view taken along lines 2—2 of FIG. 3.
Figure 3:
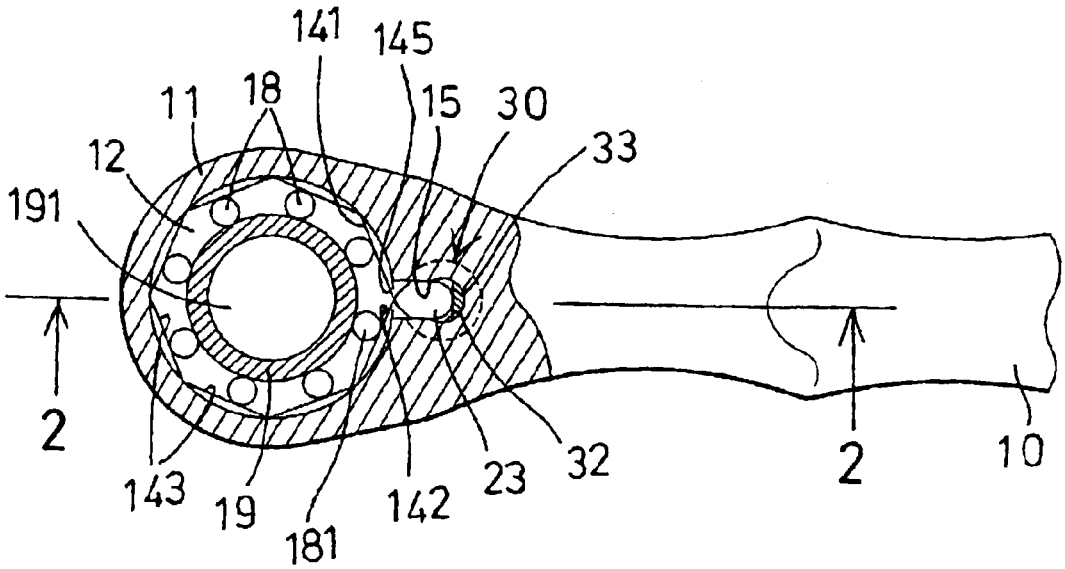
FIG. 3 is a partial cross sectional view taken along lines 3—3 of FIG. 2.

Referring to the drawings, and initially to FIGS. 1–3, a ratchet wrench in accordance with the present invention comprises a driving member 10, such as a handle 10, and a head 11 formed or provided on one end of the handle 10. The head 11 includes a chamber 12 formed therein and defined by two or more flat or actuating surfaces 141, 142, 143 which may form one or more corners 145 therebetween.

One or more rollers or rods 18, 181 are received in the chamber 12 of the head 11, and equally spaced away from each other, and engaged with the actuating surfaces 141, 142, 143 of the head 11 respectively. A follower or a driven member 19 is rotatably received in the chamber 12 of the head 11, and engaged with the rods 18, 181, or arranged within the rods 18, 181, for allowing the rods 18, 181 to be engaged between the driven member 19 and the actuating surfaces 141, 142, 143 of the head 11 respectively.

The driven member 19 may include an opening 191 formed therein (FIGS. 3, 5) to receive fasteners, tool extensions (not shown) or the like, for allowing the fasteners or the tool extensions to be rotated or driven together with the driven member 19. The driven member 19 may further include a stud 193 extended therefrom for engaging with fasteners, sockets, tool extensions (not shown) or the like, and for allowing the fasteners or the sockets or the tool extensions to be rotated or driven together with the driven member 19.

A switching member 20 is rotatably attached onto the head 11, and includes one or more fingers 21 extended therefrom and engaged into the chamber 12 of the head 11, and engaged with or engaged between the rods 18, 181, for moving the rods 18, 181 to engage with different actuating surfaces 141, 142, 143 of the head 11 respectively.

Figure 5:
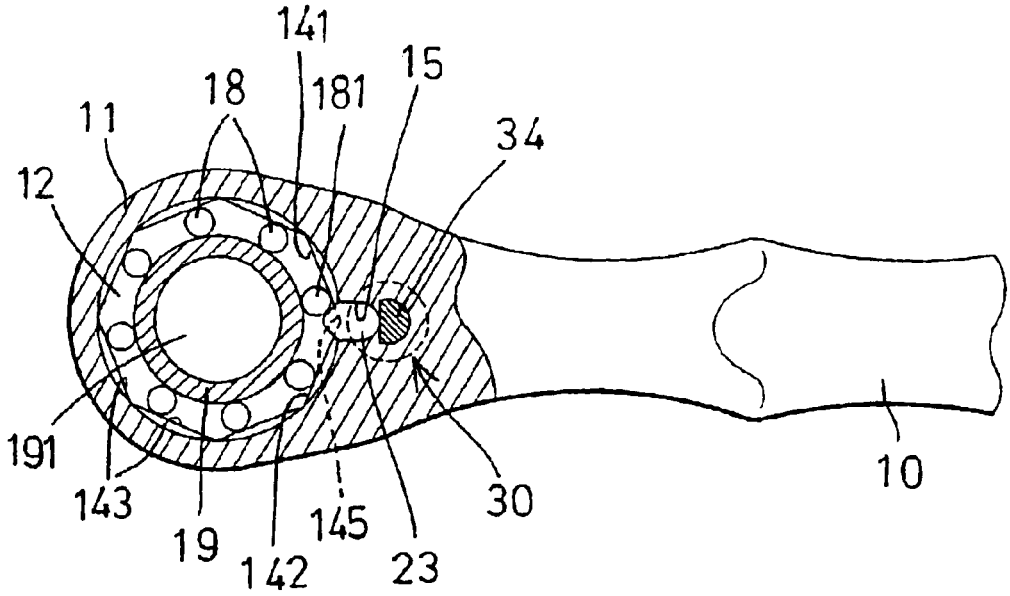

For example, as shown in FIGS. 3 and 5, one of the rods 181 is received in one of the corners 145 of the head 11 (FIGS. 1, 3, 5), and disposed between the actuating surfaces 141, 142 of the head 11. One of the fingers 21 of the switching member 20 may move the rod 181 across the corner 145 of the head 11, to engage with either of the actuating surfaces 141, 142 of the head 11, as best shown in FIGS. 3 and 5.

In operation, as shown in FIG. 3, when the rod 181 is engaged with the actuating surface 142 of the head 11, the driven member 19 may be rotated or driven counterclockwise by the handle 10, but may not be rotated or driven clockwise by the handle 10.

On the contrary, as shown in FIG. 5, when the rod 181 is engaged with the other actuating surface 141 of the head 11, the driven member 19 may be rotated or driven clockwise by the handle 10, but may not be rotated or driven counterclockwise by the handle 10.

The above-described configuration of the ratchet wrench including the driving head 11, the actuating surfaces 141, 142, the rods 18, 181, the switching member 20, and the driven member 19, is typical, and will not be described in further details.

Figure 8:
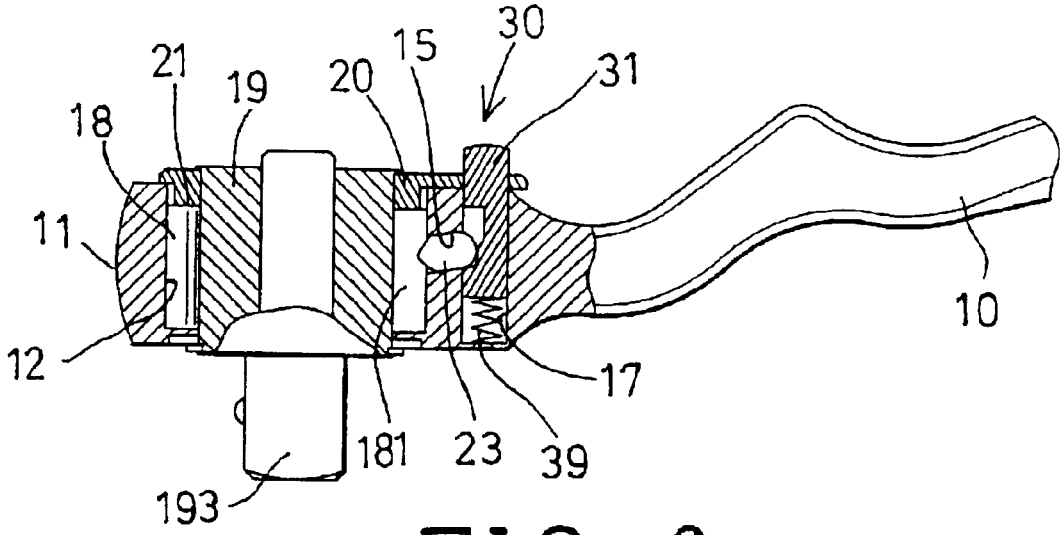
FIGS. 7, 8 are partial cross sectional views of the ratchet wrench as shown in FIG. 6, illustrating the operation of the ratchet wrench.
Figure 7:
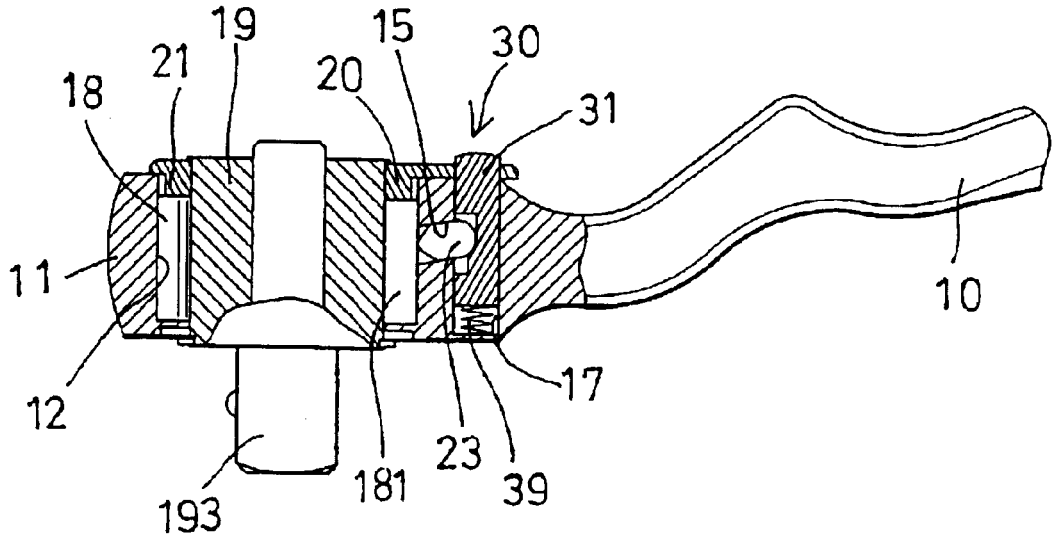

The head 11 further includes a groove 15 formed therein and communicating with the chamber 12 thereof to slidably receive a detent 23 therein. The groove 15 of the head 11 is substantially parallel to the handle 10, but may be slightly inclined relative to the handle 10 or the head 11 (FIGS. 7, 8). The head 10 includes a channel 17 formed therein and substantially perpendicular to the handle 10, and communicating with the groove 15 of the head 11.

The groove 15 and the channel 17 may be formed in either the handle 10 or the head 11, or may be formed between the handle 10 or the head 11. The handle 10 or the head 11 may further include a recess 171 formed therein (FIG. 1), and communicating with the channel 17 of the head 11. It is preferable that the groove 15 of the head 11 is formed in one of the corners 145 of the head 11 (FIGS. 1, 3, 5).

An actuating device 30 includes a stem 31 slidably received in the channel 17 of the head 1I. The stem 31 includes a cavity 32 formed therein, and defined by a shank 33, to receive the detent 23 (FIG. 3), for allowing the detent 23 to be disengaged from the chamber 12 of the head 11, and to be disengaged from the rod 181.

The actuating device 30 further includes an elevated seat 34 provided therein to engage with the detent 23, and to force the detent 23 into the chamber 12 of the head 11 (FIG. 5), in order to engage with the rod 181, and so as to retain the rod 181 in acting with or in engagement the actuating surface 141 of the head 11.

The detent 23 may thus engage with the rod 181, in order to prevent the rod 181 from moving across the corner 145 of the head 11, and may thus be provided to retain the rod 181 in engagement or in acting with the actuating surface 141 of the head 11, and may thus be provided to prevent the rod 181 from being engaged with the other actuating surface 142 of the head 11.

As shown in FIG. 3, the rod 181 may be moved across the corner 145 of the head 11, to engage with the other actuating surface 142 of the head 11 by the finger 21 of the switching member 20, only when the detent 23 is disengaged from the chamber 12 of the head 11, and disengaged from the rod 181, and received in the cavity 32 of the stem 31.

The detent 23 may then be forced into the chamber 12 of the head 11 again by the elevated seat 34 of the actuating device 30, in order to engage with the rod 181, and so as to retain the rod 181 in acting with or in engagement the other actuating surface 142 of the head 11.

Accordingly, the provision of the detent 23 to engage into the chamber 12 of the head 11 and to engage with the rod 181 may prevent the rod 181 from moving across the corner 145 of the head 11, and may thus be provided to solidly retain the rod 181 in engagement or in acting with either of the actuating surfaces 141, 142 of the head 11, and may thus be provided to prevent the rod 181 from being engaged with the other actuating surface 142, 141 of the head 11 inadvertently.

The stem 31 of the actuating device 30 further includes an enlarged knob 37 attached to one end thereof, and receivable in the recess 171 of either the handle 10 or the head 11, for allowing the actuating device 30 to be moved or depressed by the users, and for allowing the cavity 32 of the stem 31 to receive the detent 23, or for forcing the elevated seat 34 of the actuating device 30 to move the detent 23 into the chamber 12 of the head 11 and thus to engage with the rod 181.

Figure 4:
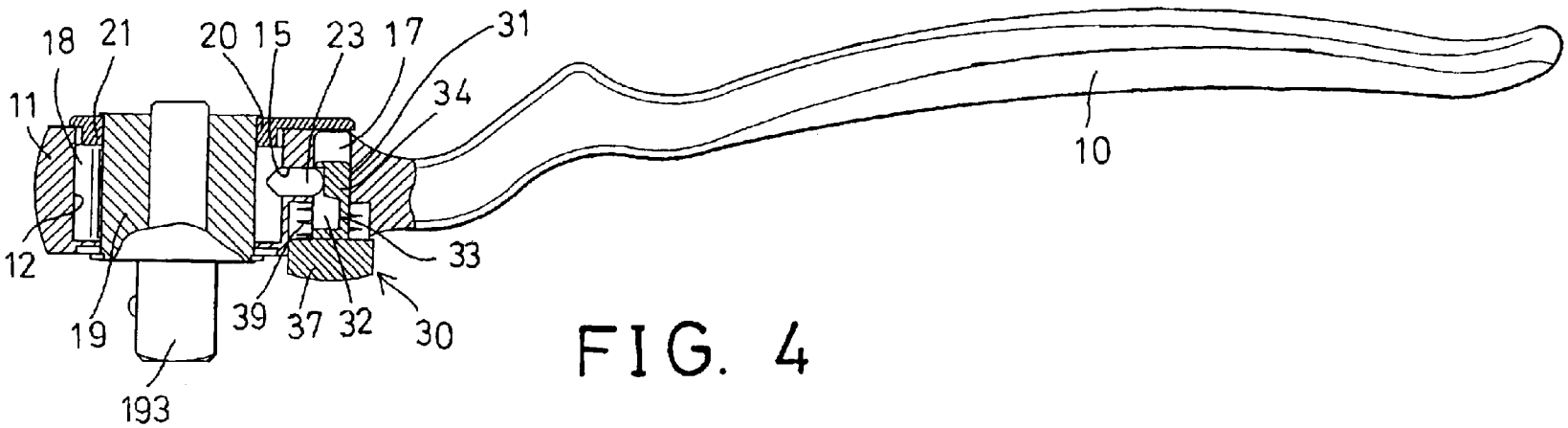
FIGS. 4, 5 are partial cross sectional views similar to FIGS. 2 and 3 respectively, illustrating the operation of the ratchet wrench.

The actuating device 30 further includes a spring member 39 engaged between the actuating device 30 and the handle 10 or the head 11, for forcing the elevated seat 34 of the actuating device 30 to move the detent 23 into the chamber 12 of the head 11 and thus to engage with the rod 181 (FIG. 4), when the knob 37 of the actuating device 30 is released.

Figure 6:
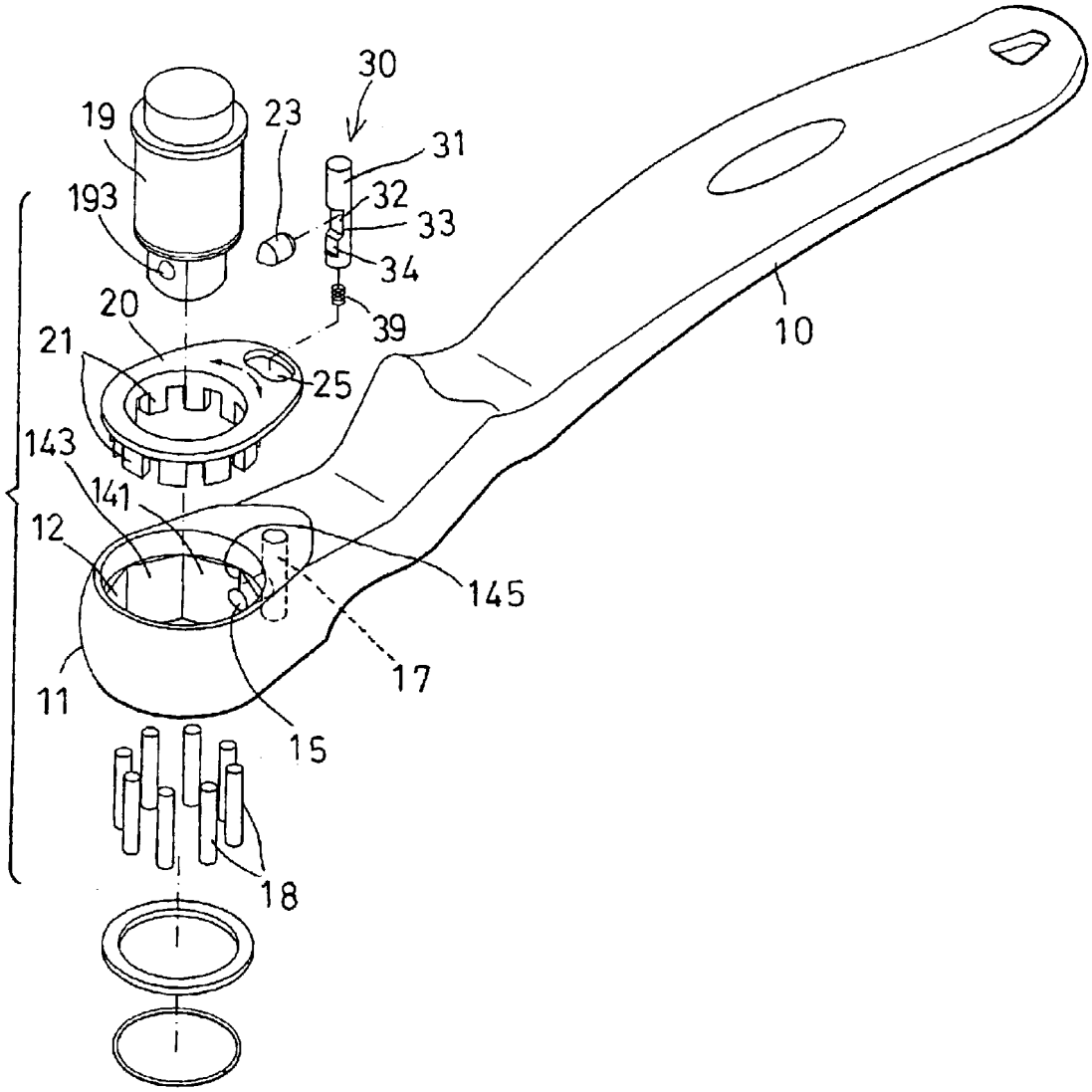
FIG. 6 is an exploded view similar to FIG. 1, illustrating the other embodiment of the ratchet wrench.

Alternatively, as shown in FIGS. 6–8, the actuating device 30 may be disposed in different direction as that shown in FIGS. 1–5, the spring member 39 may also be used to force the elevated seat 34 of the actuating device 30 to move the detent 23 into the chamber 12 of the head 11 and thus to engage with the rod 181 (FIG. 8) when the actuating device 30 is released.

As best shown in FIG. 6, the switching member 20 may include an oblong hole 25 formed therein, to slidably receive one end of the stem 31 of the actuating device 30, for allowing the switching member 20 to be rotated relative to the head 11, and to move the rod 181 across the corner 145 of the head 11, and to engage with either of the actuating surfaces 141, 142 of the head 11.

Accordingly, the ratchet wrench in accordance with the present invention includes a switch locking device to lock the switching or actuating member of the ratchet wrench, and to prevent the ratchet wrench from being switched to different rotating or driving directions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a driving head including a chamber formed therein, and including a first actuating surface and a second actuating surface, and a corner formed between said first and said second actuating surfaces of said driving head, a driven member rotatably received in said chamber of said driving head, a rod received in said chamber of said driving head, and engaged between said driving head and said driven member, and movable across said corner of said driving head, to engage with either said first actuating surface or said second actuating surface of said driving head, and means for preventing said rod from moving across said corner of said driving head, to retain said rod in engagement with either said first actuating surface or said second actuating surface of said driving head.

2. The ratchet wrench as claimed in claim 1, wherein said preventing means includes a detent slidable into said chamber of said driving head, to engage with said rod, and to retain said rod in engagement with either said first actuating surface or said second actuating surface of said driving head.

3. The ratchet wrench as claimed in claim 2, wherein said driving head includes a groove formed therein and communicating with said chamber thereof to slidably receive said detent therein.

4. The ratchet wrench as claimed in claim 2, wherein said preventing means further includes an actuating device slidably received in said driving head, to selectively force said detent into said chamber of said driving head and to engage with said rod.

5. The ratchet wrench as claimed in claim 4, wherein said actuating device includes a stem having a seat provided therein, to selectively engage with said detent, and thus to selectively force said detent into said chamber of said driving head and to engage with said rod.

6. The ratchet wrench as claimed in claim 5, wherein said stem of said actuating device includes a cavity formed therein, to selectively receive said detent, and to allow said detent to be disengaged from said chamber of said driving head and to be disengaged from said rod.

7. The ratchet wrench as claimed in claim 5 further comprising means for biasing said seat to engage with said detent.

* * * * *